US005789872A

United States Patent [19]

Kohga et al.

[11] Patent Number: 5,789,872

[45] Date of Patent: Aug. 4, 1998

[54] LEAKAGE FIELD DECREASING DEVICE FOR CRT DISPLAY

[75] Inventors: Tetsuya Kohga; Takashi Kinoshita, both of Kanagawa, Japan

[73] Assignee: Matsushita Electric Industrial Co., Ltd., Osaka, Japan

[21] Appl. No.: 603,225

[22] Filed: Feb. 20, 1996

[30] Foreign Application Priority Data

Feb. 20, 1995 [JP] Japan ..... 7-030741

[51] Int. Cl.[6] ..... G09G 1/04; H01J 29/06; H01J 1/52

[52] U.S. Cl. ..... 315/370; 315/8; 315/85

[58] Field of Search ..... 315/8, 85, 370

[56] References Cited

U.S. PATENT DOCUMENTS

| | | | |
|---|---|---|---|
| 5,151,635 | 9/1992 | Capples | 315/370 |
| 5,243,262 | 9/1993 | Moen | 315/370 |
| 5,311,099 | 5/1994 | Grocki | 315/8 |
| 5,396,151 | 3/1995 | Cappels, Sr. | 315/8 |
| 5,432,411 | 7/1995 | Beeteson et al. | 315/370 |
| 5,534,756 | 7/1996 | Beeteson et al. | 315/370 |

FOREIGN PATENT DOCUMENTS

| | | |
|---|---|---|
| 0 500 349 | 8/1992 | European Pat. Off. . |
| 0 630 036 | 12/1994 | European Pat. Off. . |
| 41 23 565 | 9/1992 | Germany . |
| 4-315741 | 11/1992 | Japan . |
| 6-189323 | 8/1994 | Japan . |

*Primary Examiner*—Gregory C Issing
*Attorney, Agent, or Firm*—McDermott, Will & Emery

[57] ABSTRACT

The invention provides a device for effectively decreasing the electric field irradiated from the front surface of a CRT display. This device cancels the leakage field composed of a deflection component and a high voltage ripple component irradiated in the front direction of the CRT by generating an inverse electric field composed of the deflection component and high voltage ripple component. The inverse electric field is obtained by detecting an alternating-current voltage irradiated in the anode portion of the CRT by capacitive coupling a detector to the anode, inverting and amplifying the detected voltage, and applying the inverted voltage to an inverse field generating means installed near the front surface of the CRT.

15 Claims, 5 Drawing Sheets

LEAKAGE FIELD DECREASING DEVICE FOR CRT DISPLAY

FIELD OF THE INVENTION

1. Background of the Invention

The present invention relates to a device for decreasing a leakage field irradiated in the front direction of a Cathode Ray Tube ("CRT") display.

Recently, as a result of wide distribution of computer appliances, the CRT display comes to be used widely at home and in the office. Accordingly, the adverse effects of an electric field or a magnetic field leaking from the CRT display on human health and other electric appliances are topics receiving much discussion.

2. Conventional Art

Outline of operation of a well-known CRT display (or CRT) is described below. A deflection yoke is driven in a deflection circuit, and deflects an electron beam passing through the CRT in the horizontal and vertical directions. A high voltage output, after being rectified in a horizontal synchronous period from a high voltage generating circuit containing a FBT ("flyback transformer"), is supplied to an anode of the CRT through an anode cable as an acceleration voltage of the CRT. The CRT is coated with a metal backing inside of the cone-shaped glass wall of the CRT, and inside of the front glass panel, and the anode is electrically connected to the metal backing and the shadow mask disposed behind inside of the front panel of the CRT. The metal backing and "Aquadaque" formed outside of the CRT comprise a capacitor, and the above high voltage charges the capacitor. The beam current of the CRT is controlled by a video signal entering from the video circuit, and the CRT displays the picture. The beam current flows while displaying the picture, but does not flow in the horizontal and vertical flyback time. The capacitor composed of the glass wall of the CRT is charged up in the horizontal and vertical flyback time because beam current does not flow, but while displaying the picture, that is, while beam current is flowing, it is discharged. Therefore, due to fluctuations of the beam current, the anode voltage generates ripple voltages in the horizontal and vertical period.

A prior art CRT display is described below by referring to FIG. 9. Conventionally, in operation of the CRT display, the leakage field induced to the front direction of the CRT 1 has been explained as follows. One of principal components of leakage field is the component formed by the voltage generated in a deflection yoke 2 (hereinafter called "deflection component D"). Another one of the components is the component formed by ripple voltages of the high voltage (hereinafter called "high voltage ripple component V") from all constituent parts connected to the anode (hereinafter called the "anode potential band") e.g., such as an anode cable 3, CRT shadow mask 4, and metal coated parts 5 (or metal backing) inside of the CRT. During operation of the CRT display, the leakage field induced to the front direction of the CRT display is a synthesis of deflection component D and high voltage ripple component V.

As a means for decreasing the leakage field from the CRT display, it may be first considered to effectively shield the CRT by using a metal plate 5 or the like. This means may be executed easily on the side and back surfaces of the CRT 1, but such a metal plate 5 cannot be applied on the front surface of the CRT 1 because of the purpose of use of the CRT display. It is hence proposed to mount a transparent panel on the surface of the CRT 1 or the front surface of the CRT 1, and coat its surface with a "see-through conductive film," thereby enhancing the shielding effect. This means of applying a conductive coating on the surface of the CRT 1 has, however, its problems in the cost and productivity.

For example, in Japanese Laid-open Patent No. 6-189323, the following method is disclosed as the means of decreasing the leakage field induced to the front direction of the CRT 1. Referring to FIG. 9, a lead wire is wound around the front surface of the CRT 1, and it is formed as an inverse field generating means 6. The voltage showing an inverse polarity of the voltage generated in the deflection yoke 2 is picked up from a deflection circuit 7, and it is used as an inverse polarity field generating voltage. This inverse polarity field generating voltage is applied to the inverse field generating means 6, and the leakage field ahead of the CRT 1 is canceled.

As mentioned above, the principal irradiation components of the leakage field from the front surface of the CRT display front surface comprise the deflection component D from the deflection yoke 2 and the high voltage ripple component V from the anode potential band, and these combined leakage fields cannot be canceled by use of the deflection component D alone. That is, the leakage field due to the high voltage ripple component V was not decreased at all, and an effective decrease of leakage field was not attained.

As a means for solving the problems, means for canceling the leakage field is disclosed, for example, in Japanese Laid-open Patent No. 4-315741, where it is proposed to provide individual measures for the deflection component D from the deflection yoke 2 and the high voltage ripple component V from the anode potential band. In both measures, by making use of the voltage obtained from the internal circuit of the CRT display 1, a voltage for generating a canceling field is obtained. Against the deflection component D, the voltage taken out from a FBT 8 is utilized. This voltage is applied to the inverse field generating means 6 through a phase adjusting circuit 9. Moreover, against the high voltage ripple component V, the high voltage delivered through a high voltage generating circuit 10 from the FBT 8 is divided by resistance $R_1$, R2, and a divided voltage is obtained, and applied to the inverse field generating means 6 through the phase adjusting circuit 9 and inverting circuit 11.

In the conventional means, the voltage applied to the inverse field generating means 6 was obtained by processing one from the deflection circuit 7 and the other from the high voltage generating circuit 10, which was very troublesome.

Moreover, since the acceleration voltage of the CRT display is a high voltage close to 30 kV. When dividing the acceleration voltage by resistance for supplying voltage, the resistance value of the resistor must be high for decreasing an electric power consumption and other reasons. In particular, the resistance value of the $R_1$ must be about 1000 Mohms to 100 Mohms. Owing to a withstand voltage and other reasons, the shape of the resistor is large in size.

Therefore, the resistor is susceptible to effects of the surrounding electric field. In addition, the divided voltage waveform is deformed by the distribution capacity of the resistors. As a result, in the voltage divided by resistors, an unexpected voltage waveform is superposed, and favorable results are not obtained. That is, the obtained voltage waveform was large in difference from the expected alternating-current voltage waveform, and the leakage field could not be decreased sufficiently.

None of the Laid Open Publications described above provides the important advantages of the invention in providing a leakage field decreasing device for a CRT display which is capable of canceling effectively the principal components of deflection component and high voltage ripple component in the leakage field irradiated in the CRT display front direction, so that the leakage field decreasing device of low frequency can be obtained inexpensively and effectively.

In the light of the above problems in the prior art, it is an object of the invention to decrease the leakage field irradiated from the front surface of the CRT display by effective and inexpensive means.

SUMMARY OF THE INVENTION

The leakage field irradiated ahead of the CRT display is further observed below. Of the leakage field relatively near ahead of the CRT display, the deflection component irradiated from the deflection yoke is induced in the anode potential band including the shadow mask inside the CRT, and is irradiated. On the other hand, the voltage in the anode potential band generates high voltage ripples due to change of the beam current. Therefore, the alternating-current component of the anode potential band is accomplished by superposition of the deflection component on the high voltage ripple component, or the alternating-current component of the anode potential band is a synthesis of high voltage ripple component and deflection component.

Accordingly, the alternating-current field irradiated to the front surface of the CRT display is observed to be in the same phase and same polarity as the voltage of the alternating-current component of the anode potential band. In other words, the leakage field is irradiated ahead of the CRT display, that is, the synthesized leakage field is mainly dominated by the voltage of the alternating-current component of the anode potential band. In order to cancel the leakage field irradiated ahead of the CRT display, that is, the synthesized leakage field, it is not necessary to consider the deflection component D and high voltage ripple component V individually, but it is enough to consider only the voltage of the alternating-current component of the anode potential band, and further consideration of the deflection component D is a mere duplication.

The invention is devised by taking note of this point.

To achieve the object, the voltage waveform generated in the anode potential band is taken out directly, and utilized in generation of inverse voltage. Accordingly, the device comprises a detector for detecting a desired alternating-current voltage by capacity coupling with the anode potential band, an inverting amplifier, and inverse field generating means, wherein the alternating-current voltage causing the leakage field irradiation in the CRT front direction by anode potential band is detected by the detector by capacitive coupling, the detected desired alternating-current voltage waveform is inverted and amplified to a desired voltage in the inverting amplifier, and is applied to the inverse field generating means disposed near the front surface of the CRT, and the leakage field irradiated ahead of the CRT display is canceled by this inverse polarity field. In detection, it is important to shield the detector sufficiently so as not to mix in the undesired voltage due to induction of floating undesired electric field.

A present invention includes a method for decreasing a leakage field in a CRT display used to display a desired image. The method comprising the steps of:

detecting by a detector an alternating-current voltage component for generating a leakage field irradiated in a front direction of the CRT by capacitive coupling with an anode potential band;

amplifying the alternating-current component detected by the detector by an inverting amplifying circuit for inverting the polarity;

applying the alternating-current voltage component inverted and amplified by the inverting amplifying circuit by an inverse field generating means being disposed near a CRT front surface, and generating an electric field in reverse polarity to the leakage field generated in the CRT front direction.

Therefore, although individual measures were done on the deflection component D and high voltage ripple component V in the conventional method, the invention requires to take out the objective voltage only from one position. This method is enough and accurate. As pointed out in greater detail below, this invention provides important advantages of decreasing the leakage field irradiated from the front surface of the CRT display by effective and inexpensive means.

The invention itself, together with further objects and attendant advantages, will best be understood by reference to the following detailed description taken in conjunction with the accompanying drawings.

DETAILED DESCRIPTION OF THE INVENTION

Exemplary Embodiment

Figure 1:
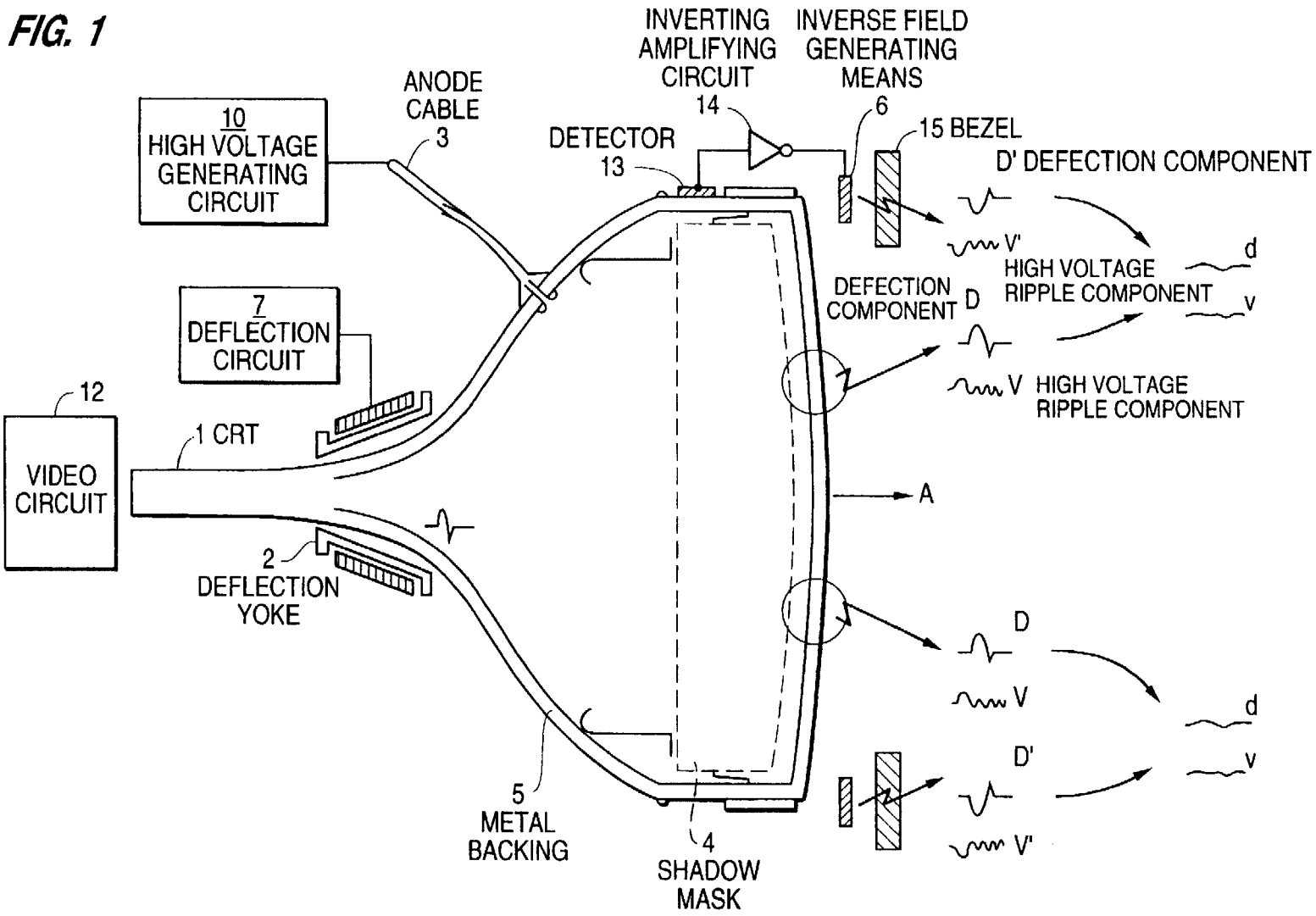
FIG. 1 is a structural diagram of a leakage field decreasing device of a CRT display in an embodiment of the invention.
Figure 9:
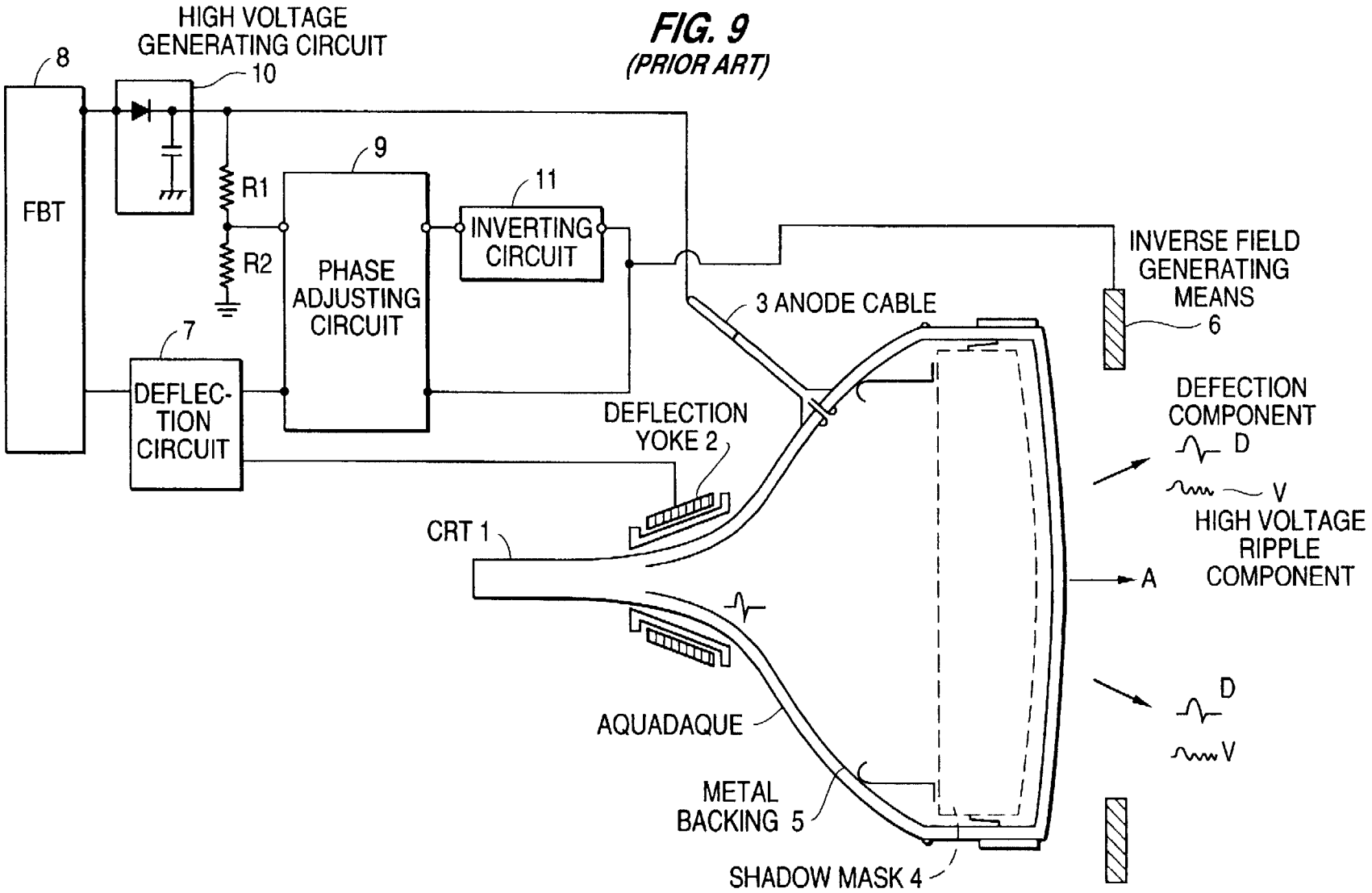
FIG. 9 (PRIOR ART)
FIG. 9 is a structural diagram of essential parts of a conventional CRT display device.

FIG. 1 is a structural diagram of essential parts of a leakage field decreasing device of the CRT display 1 in an embodiment of the invention. Same constituent components as in the prior art in FIG. 9 are identified with same reference numerals. The operation of the leakage field decrease in the constitution shown in FIG. 1 is described. A metal plate (not shown) is disposed at the side and back surfaces of a CRT 1, and this metal plate effectively shields the leakage field in the side and back directions of the CRT 1. A deflection yoke 2 is driven by a deflection circuit 7, and electron beams passing through the CRT 1 are deflected in the horizontal and vertical directions. At this time, the voltage generated at the deflection yoke 2 is induced in the anode potential band, and is irradiated in the front direction (arrow A) of the CRT 1, through a shadow mask 4 composed of a conductive material. This component is a deflection component D.

The high voltage delivered from a high voltage generating circuit 10 is applied to the anode potential band containing the shadow mask 4 through an anode cable 3. At the same time, a video signal from a video circuit 12 enters the CRT 1, and hence the beam current is modulated. The high voltage output from the high voltage generating circuit 10 fluctuates by the changes of beam current, that is, load fluctuations, and generates a ripple voltage. This ripple voltage is irradiated in the front direction (arrow A) of the CRT 1. This component is a high voltage ripple component V. Therefore, the alternating-current component of the anode potential band is a superposition of the deflection component D on the high voltage ripple component V.

It is thus understood that the leakage field irradiated in the front direction of the CRT 1 is formed by the alternating-current voltage generated in the shadow mask 4. Accordingly, a detector 13 is provided, and the alternating-current voltage waveform in the anode potential band including the shadow mask 4 is detected by capacitive coupling. In this detection, it is necessary to prevent induction of unexpected field near the output obtained in the detector.

The detected alternating-current voltage is inverted and amplified to a specified voltage level in an inverting amplifier 14, and the inverted and amplified voltage is applied to inverse field generating means 6 installed near (or at a predetermined location in proximity to) the front surface of the CRT 1. This inverse field generating means 6 is composed of a metal plate or coil-shaped lead wire, and is insulated so as not to contact with the surface of the CRT 1, being disposed between the CRT 1 and a bezel 15. As a result, an inverse electric field generated by the inverse field generating means 6 works to cancel the leakage field from the front surface of the CRT 1. In more detail, the inverse electric field generated from the inverse field generating means 6 works to cancel the synthesized leakage field of the deflection component D and the high voltage ripple component V of the leakage field irradiated in the front direction of the CRT 1, by the synthesized inverse field of deflection component D' and high voltage ripple component V' in the same phase and in reverse polarity of the synthesized leakage field. As a result, the synthesized leakage field is decreased, and the slightly remaining deflection component and high voltage ripple component are indicated by d and v in FIG. 1.

Figure 2:
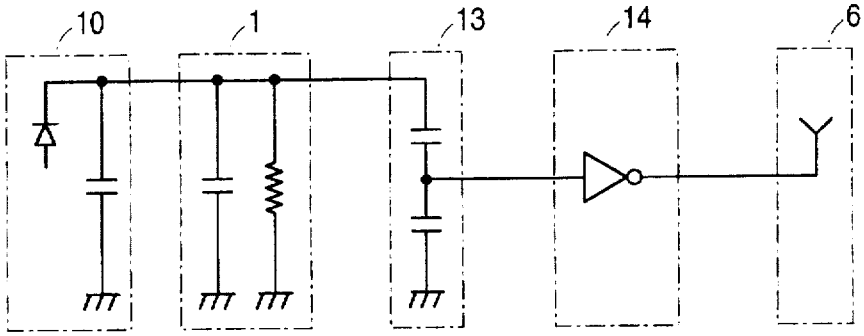
FIG. 2 is a block diagram of an electric circuit of the leakage field decreasing device in FIG. 1.

FIG. 2 is a block diagram of an electric circuit in FIG. 1 for canceling this leakage field.

Figure 3:
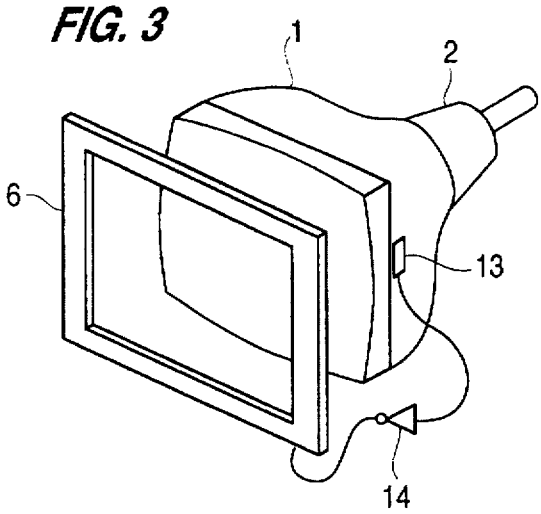
FIG. 3 is a perspective exploded view showing the structure of inverse field generating means of the leakage field decreasing device in FIG. 1.
Figure 4:
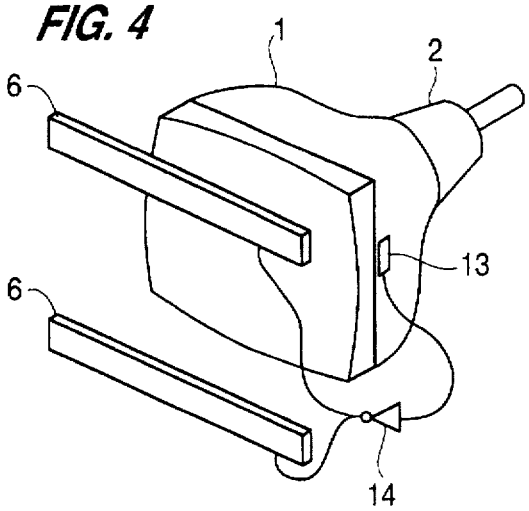
FIG. 4 is a perspective exploded view of other structure than the one in FIG. 3 showing a structure of inverse field generating means of the leakage field decreasing device in FIG. 1.

Structural examples of the inverse field generating means 6 shown in FIG. 1 are shown in perspective views in FIG. 3 and FIG. 4. FIG. 3 shows the inverse field generating means 6 composed of a frame-shaped, metal plate, which is insulated and disposed so as not to contact with the surface of the CRT 1. FIG. 4 is similar to the frame shape in FIG. 3, except that the vertical side metal plate is not used while the lower side metal plate is used. The inverse field generating means 6 shown in FIG. 4 comprises a metal plate divided into upper side and lower side, and is insulated so as not to contact with the surface of the CRT 1. The inverse field generating means 6 shown in FIG. 4 is effective on the irradiation in the forward 45-degree direction in consideration of the irradiation pattern to the periphery of the CRT 1. The difference in irradiation pattern due to difference of the inverse field generating means 6 is shown in FIG. 5 in which:

(a) is an irradiation pattern without inverse field generating means 6;

(b) is one by using the frame-shaped metal plate in FIG. 3; and (c) is one using the upper and lower split metal plate in FIG. 4.

Figure 5:
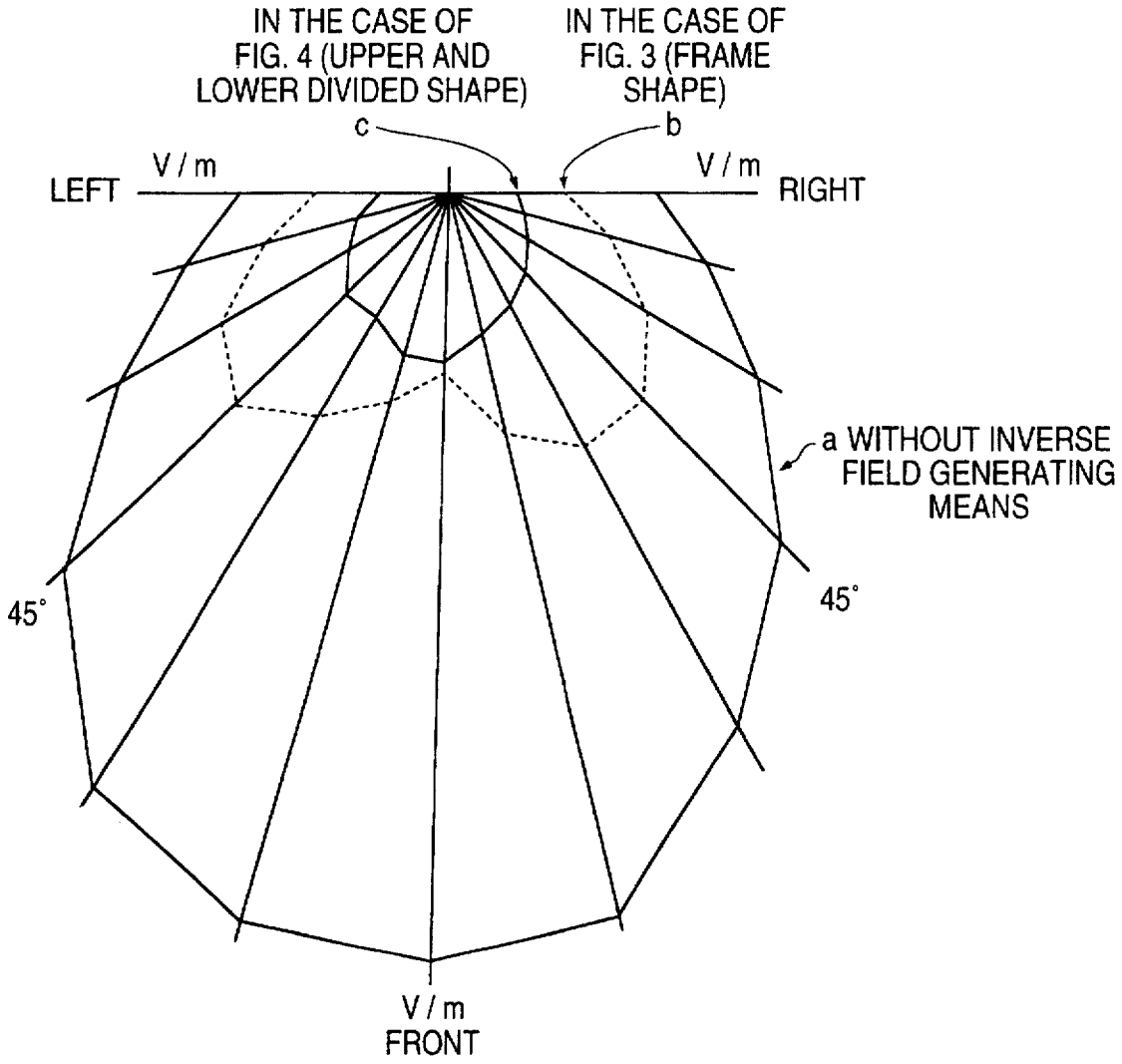
FIG. 5 is a diagram of irradiation patterns explaining the difference in the leakage field decreasing effect in the prior art and in FIG. 3 and FIG. 4.

As known from FIG. 5, as compared with the front direction, the irradiation level is lower in the 45-degree direction. Accordingly, in the case of (b) of the frame shape in FIG. 3 excessive cancellation occurs in the 45-degree direction, and the irradiation level is worse as compared with the front surface. Hence, in the case of (c) of the upper and lower divided shape shown in FIG. 4 by eliminating the metal plate in the vertical side of the frame shape in FIG. 3, effective cancellation is also enabled in the 45-degree direction. Moreover, the inverse field generating means 6 may be also composed of a conductor of other shape, for example, a coil-shaped lead wire, or a demagnetization coil may be also used.

Figure 6:
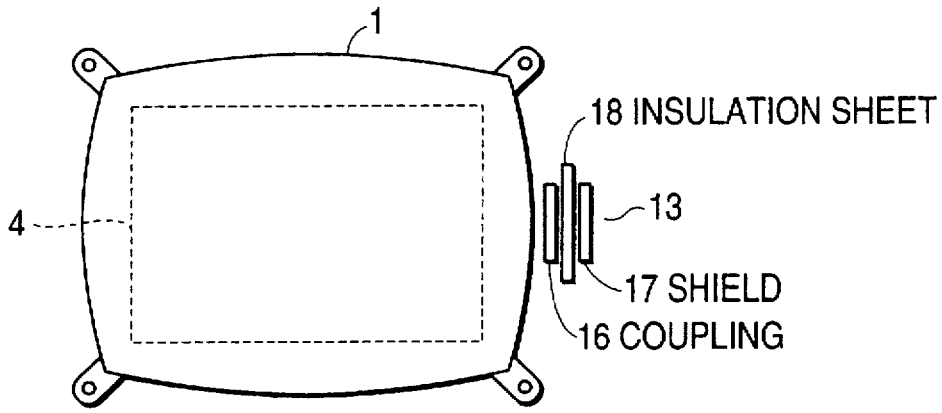
FIG. 6 is a sectional view seen from the CRT front side, showing a structure of detector of the leakage field decreasing device in FIG. 1.
Figure 7:
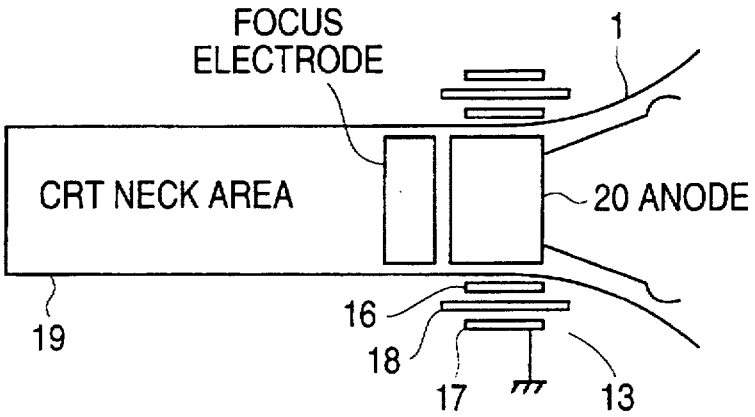
FIG. 7 is a sectional view of other structure than the one in FIG. 6 showing a structure of detector of the leakage field decreasing device in FIG. 1.
Figure 8:
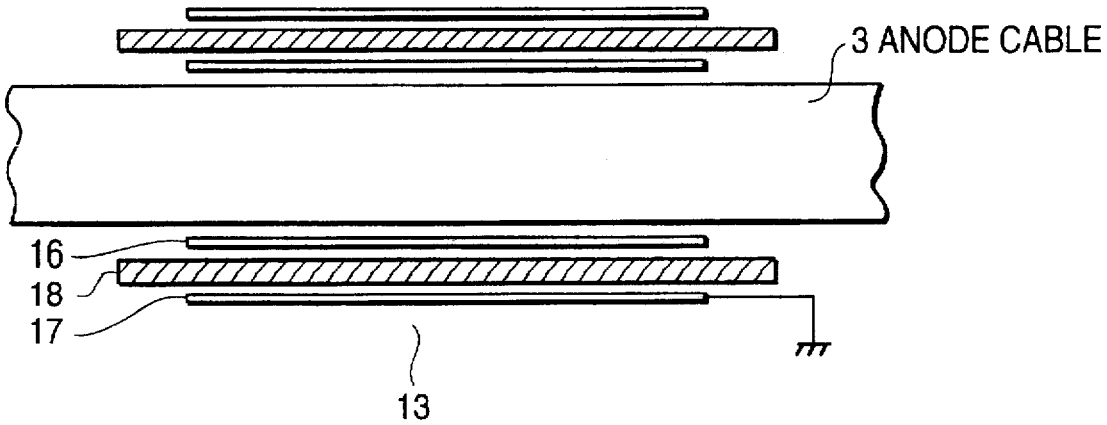
FIG. 8 is a sectional view of other structure than the one in FIG. 6 or FIG. 7, showing a structure of detector of the leakage field decreasing device in FIG. 1.

Variations on the embodiments described above are possible. For example, other structural examples of the detector 13 in FIG. 1 are shown in FIGS. 6, 7, and 8. Turning now to FIG. 6, in a front view of the CRT 1, the detector 13 is disposed near the front side shadow mask 4 of the side surface of the CRT 1. The detector 13 is composed of a coupling 16, a shield 17, and an insolation sheet 18. The coupling 16 and shield 17 are composed of conductors, and the coupling 16 is disposed in the periphery of the shadow mask 4 of the CRT 1. The coupling 16 forms a coupling capacity enclosing the glass wall of the CRT 1 and the anode potential band including the shadow mask 4, and its static capacity is, for example, a capacity of scores of picofarads. The anode alternating-current component is divided in C by the coupling capacity and the input capacity of the inverting amplifier 14. This divided output is handled as the detection value. The shield 17 is disposed so as to cover the coupling 16 in order to cut off the effects of undesired electric field from outside. At this time, the coupling 16 and the shield 17 are insulated by the insulation sheet 18 so that the parts may not contact with each other.

In another variation, FIG. 7 is a sectional view of essential parts disposing the detector 13 in a CRT neck area 19 of FIG. 1. This detector 13 is also composed of coupling 16, shield 17, and insulation sheet 18 same as in FIG. 6. The coupling 16 and shield 17 are composed of conductors, and the coupling 16 is disposed in the CRT neck area 19 around an anode (g4) 20 in the electron gun of the CRT 1, and is coupled with the anode 20 by a capacity of, for example, scores of picofarads, and the anode alternating-current voltage component is detected in C division. The shield 17 is disposed so as to cover the coupling 16 for cutting off the direct effects from outside such as deflection yoke 2. At this time, the coupling 16 and shield 17 are insulated by the insulation sheet 18 so that the parts may not contact with each other.

In yet another variation, FIG. 8 is a sectional view of essential parts disposing the detector 13 around the anode cable 3 in FIG. 1. This detector 13 also composed of coupling 16, shield 17, and insulation sheet 18 same as in FIG. 6. The coupling 16 and shield 17 are composed of conductors, and the coupling 16 is disposed so as to surround the anode cable 3, and is coupled with the anode potential band by a capacity of, for example, scores of picofarads, and the anode alternating-current voltage component is detected in C division. The shield 17 is disposed so as to cover the coupling 16 for cutting off the effects of undesired electric field from outside. At this time, the coupling 16 and shield 17 are insulated by the insulation sheet 18 so that the parts may not contact with each other. The detector 13 of the anode alternating-current voltage component may be other means for detecting by capacitive coupling from the anode potential band.

The embodiments described above provide a number of significant advantages. As described above, the leakage field decreasing device for CRT display of the invention is capable of canceling effectively the principal components of deflection component and high voltage ripple component in the leakage field irradiated in the CRT display front direction, so that the leakage field decreasing device of low frequency can be obtained inexpensively and effectively.

According to the experiment, the leakage field irradiated in the CRT front direction could be decreased infinitely to zero by use of the invention.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed:

1. A device for decreasing a leakage field irradiated in a front direction of a CRT display comprising:

a detector for detecting an alternating-current voltage component of an anode potential band of the CRT display, said detector capacitively coupled with the anode potential band;

an inverting amplifying circuit for inverting the polarity and amplifying the alternating-current component detected by the detector; and an inverse field generating means coupled to the inverting amplifying circuit for generating an electric field in reverse polarity to the leakage field irradiated in the CRT front direction, said inverse field generating means disposed near a CRT front surface;

wherein the inverse field generating means comprises metal members disposed parallel in an upper and lower side of a front surface of the CRT display, and said detector comprises a coupling for capacitively coupling with the anode potential band, a shield for cutting off any nearby electric field, and an insulator for isolating the coupling from the shield.

2. The device of claim 1, wherein the inverse field generating means comprises a frame-shaped metal plate.

3. The device of claim 1, wherein the inverse field generating means comprises a coil-shaped lead wire.

4. The device of claim 1, wherein the detector is disposed near a front side mask at a CRT side surface.

5. The device of claim 1, wherein the CRT display has a neck area and an anode of an electron gun; and the detector is disposed at the surface of said CRT neck area around the anode.

6. The device of claim 1, wherein the CRT display has an anode cable for applying a high voltage to the CRT display from a high voltage generating circuit of the CRT display; and the detector is disposed around the anode cable.

7. A CRT display for displaying a desired image, the CRT display having a leakage field decreasing device for decreasing a leakage field irradiated in a front direction of the CRT display comprising:

a detector for detecting an alternating-current voltage component of an anode potential band of the CRT display, said detector capacitively coupled with the anode potential band;

an inverting amplifying circuit for inverting the polarity and amplifying the alternating-current component detected by the detector; and an inverse field generating means coupled to the inverting amplifying circuit for generating an electric field in reverse polarity to the leakage field irradiated in the CRT front direction, said inverse field generating means disposed near a CRT front surface;

wherein the inverse field generating means comprises metal members disposed parallel in an upper and lower side of a front surface of the CRT display, and said detector comprises a coupling for capacitively coupling with the anode potential band, a shield for cutting off any nearby electric field, and an insulator for isolating the coupling from the shield.

8. The CRT display of claim 7, wherein the inverse field generating means comprises a frame-shaped metal plate.

9. The CRT display of claim 7, wherein the inverse field generating means comprises a coil-shaped lead wire.

10. The CRT display of claim 7, wherein the detector is disposed near a front side mask at a CRT side surface.

11. The CRT display of claim 7, wherein the CRT display has a neck area and an anode of an electron gun; and the detector is disposed at the surface of said CRT neck area around the anode.

12. The CRT display of claim 7, wherein the CRT display has an anode cable for applying a high voltage to the CRT display from a high voltage generating circuit of the CRT display; and the detector is disposed around the anode cable.

13. A device for decreasing a leakage field irradiated in a front direction of a CRT display comprising:

a detector for detecting an alternating-current voltage component of an anode potential band of the CRT display, said detector capacitively coupled with the anode potential band;

an inverting amplifying circuit for inverting the polarity and amplifying the alternating-current component detected by the detector; and an inverse field generating means coupled to the inverting amplifying circuit for generating an electric field in reverse polarity to the leakage field irradiated in the CRT front direction, said inverse field generating means disposed near a CRT front surface;

wherein the CRT display has a neck area and an anode of an electron gun; and the detector is disposed at the surface of said CRT neck area around the anode, and said detector comprises a coupling for capacitively coupling with the anode potential band, a shield for cutting off any nearby electric field, and an insulator for isolating the coupling from the shield.

14. A CRT display for displaying a desired image, the CRT display having a leakage field decreasing device for decreasing a leakage field irradiated in a front direction of the CRT display comprising:

a detector for detecting an alternating-current voltage component of an anode potential band of the CRT display, said detector capacitively coupled with the anode potential band;

an inverting amplifying circuit for inverting the polarity and amplifying the alternating-current component detected by the detector; and an inverse field generating means coupled to the inverting amplifying circuit for generating an electric field in reverse polarity to the leakage field irradiated in the CRT front direction, said inverse field generating means disposed near a CRT front surface;

wherein the CRT display has a neck area and an anode of an electron gun; and the detector is disposed at the surface of said CRT neck area around the anode, and said detector comprises a coupling for capacitively coupling with the anode potential band, a shield for cutting off any nearby electric field, and an insulator for isolating the coupling from the shield.

15. A method for decreasing a leakage field in a CRT display used to display a desired image, said method comprising the steps of:

detecting an alternating-current voltage component of an anode potential band of the CRT display by capacitively coupling a detector to the anode potential band;

amplifying and inverting the polarity of the detected alternating-current component by an inverting amplifying circuit;

applying the inverted and amplified alternating-current voltage component to an inverse field generating means disposed near a CRT front surface; and generating an electric field in reverse polarity to the leakage field irradiated in the CRT front direction;

wherein the CRT display has a neck area and an anode of an electron gun; and the detecting step includes disposing the detector at the surface of said CRT neck area around the anode, and said detector comprises a shield for cutting off any nearby electric field, and an insulator for isolating the coupling from the shield.

* * * * *